US007118247B2

(12) United States Patent
Zavbi et al.

(10) Patent No.: US 7,118,247 B2
(45) Date of Patent: Oct. 10, 2006

(54) STRUCTURE FOR ILLUMINATING A ROULETTE WHEEL

(75) Inventors: Ivo Zavbi, Kamnik (SI); Urban Bergant, Kamnik (SI); Joze Pecenik, Trzin (SI)

(73) Assignee: Elektroncek d.o.o., (SI)

( * ) Notice: Subject to any disclaimer, the term of this patent is extended or adjusted under 35 U.S.C. 154(b) by 175 days.

(21) Appl. No.: 10/758,216

(22) Filed: Jan. 16, 2004

(65) Prior Publication Data

US 2004/0150992 A1 Aug. 5, 2004

(30) Foreign Application Priority Data

Jan. 16, 2003 (SI) ..... P 200300008

(51) Int. Cl.
*F21V 33/00* (2006.01)

(52) U.S. Cl. ..... 362/234; 362/253; 362/555; 362/800; 273/142 B; 273/142 E

(58) Field of Classification Search ..... 362/234, 362/253, 555, 800; 273/142 B, 142 C, 142 E; 463/17, 31

See application file for complete search history.

(56) References Cited

U.S. PATENT DOCUMENTS

| | | | | |
|---|---|---|---|---|
| 1,851,628 | A * | 3/1932 | Herrick | 273/142 E |
| 2004/0072609 | A1 * | 4/2004 | Ungaro et al. | 463/17 |
| 2005/0009603 | A1 * | 1/2005 | Munoz et al. | 463/31 |

* cited by examiner

*Primary Examiner*—Stephen F Husar
(74) *Attorney, Agent, or Firm*—Connolly Bove Lodge & Hutz LLP

(57) ABSTRACT

The object of the invention is a structure for locally illuminating a roulette wheel, particularly an automatic or electronic one. The structure consists of a support (4) which in conjunction with a spacer ring (5) forms a slit (9), wherein a band (7) with lamps (8) is mounted. On the inner periphery along the spacer ring (5) there is an optical ring (10). A cover 6is placed over the band (7), the lamps (8), and the ring (10) in such a way as to rigidly fix them.

5 Claims, 1 Drawing Sheet

STRUCTURE FOR ILLUMINATING A ROULETTE WHEEL

The object of the invention is a structure for local illumination of a roulette wheel and, more particularly, an automatic or electronic roulette wheel.

In known roulettes no separate illumination is provided to the roulette wheel. The wheel is illuminated by the general lighting or by lamps, particularly by reflector lamps installed above the roulette.

For automatic and electronic roulettes, however, specific local illumination is of particular importance, given that, as a rule, the housing and the wheel of such roulettes are covered and protected with a dome of transparent material. In such arrangements, general lighting will not illuminate the wheel in a satisfactory manner, since visibility will be impaired due to reflections.

The object of the present invention is a structure for illuminating the roulette wheel which will enable the wheel to be well illuminated locally, thus greatly improving its visibility, and which will be simple and reliable at the same time.

According to the present invention, the object is achieved with a structure designed to illuminate a roulette wheel in accordance with the appended claims.

Figure 1:
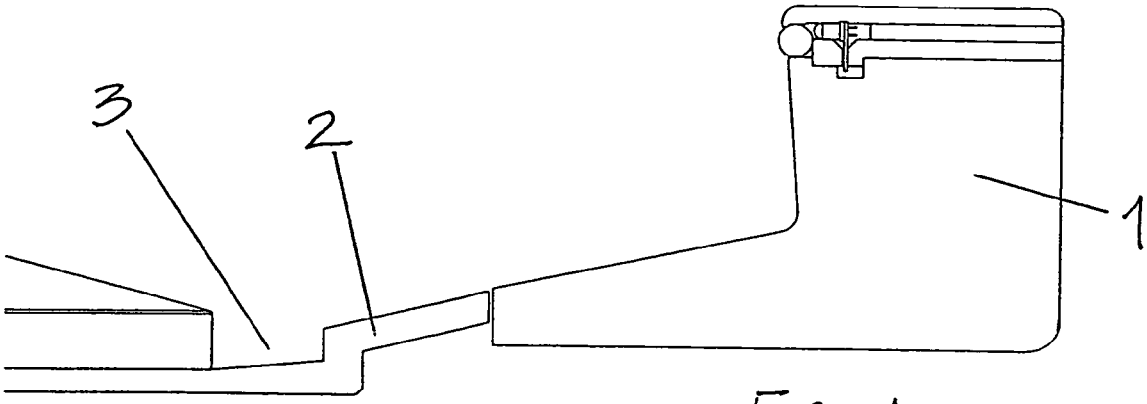
Figure 2:
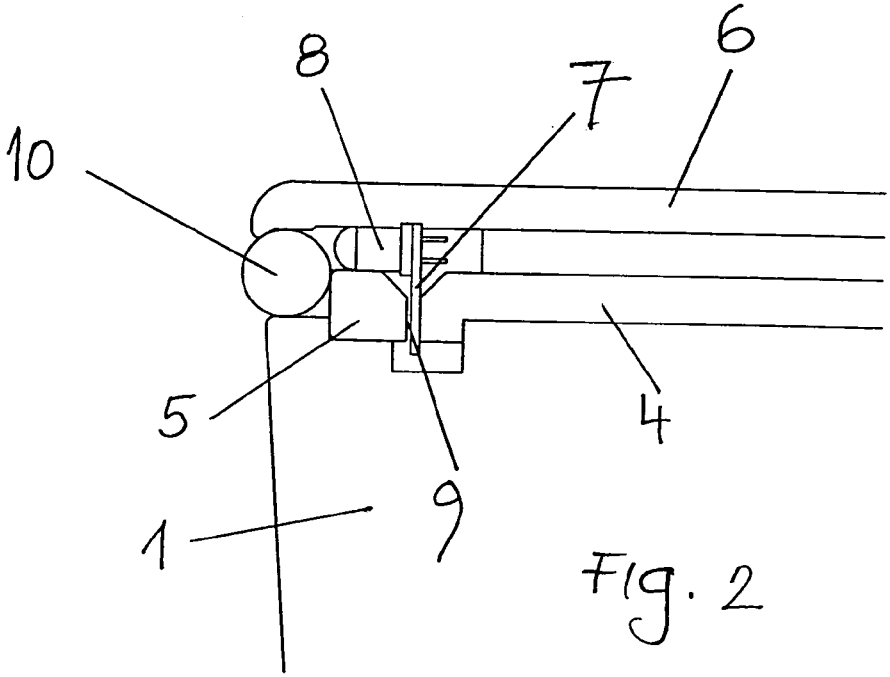

The invention shall now be described with reference to the sample embodiment and the accompanying drawings, wherein:

FIG. 1 represents a cross-section of a part of the wheel with numbered compartments and the surrounding housing; and FIG. 2 represents a cross-section of a particular of the illumination structure on the housing.

FIG. 1 shows the wheel 2 with numbers and compartments 3 for accepting the ball. The wheel 2 rotates inside the housing 1 of the roulette. Referring now to FIG. 2, the upper part of the housing 1 contains the structure for illuminating the wheel. Said structure consists of a support 4 which in conjunction with a spacer ring 5 forms a circular slit 9. As may be seen, the slit 9 is a vertical circular slit extending around the upper part of the periphery of the housing 1. A band 7 provided with lamps 8 is mounted inside the slit 9. Along the inner periphery of the spacer ring 5 in the direction of the lamps 8 there is provided an optical ring 10. To assure stability to the structure, a cover 6 is placed over the band 7, the lamps 8, and the ring 10 in such a way as to fix them. The cover 6 is fixedly attached to the housing 1.

The band 7 is formed as a band of a preferably flexible printed circuit board with two or more electrically conductive paths. To said paths, lamps 8 are mechanically fixed and electrically connected, equidistantly or otherwise spaced apart from each other. The lamps 8 may be light-emitting diodes, miniature light bulbs or other lamps appropriate for the purpose.

The optical ring 10 is a ring of a preferably circular cross-section made of transparent material. Its function is to mechanically protect the lamps 8 and to diffuse the light emitted by them.

The structure for illuminating the roulette wheel is assembled in the following way: the band 7 is inserted into the slit 9 and connected to one or more electrical power sources, whereupon the ring 10 is added and covered with the cover 6, which is then fastened to the housing 1.

It goes without saying that any structure capable of performing the mechanical and electrical functions of the band 7 comes within the scope of the invention as claimed. Likewise, in addition to the preferred circular cross-section of the ring 10, any alternative cross-sections thereof are also within the scope of the invention, provided that they perform the functions of mechanically protecting the lamps 8 and diffusing the light emitted by them.

The invention claimed is:

1. An apparatus for a roulette wheel, comprising:

a roulette wheel with numbers and compartments;

a housing configured for the roulette wheel to rotate inside the housing; and a structure for illuminating the roulette wheel, wherein, the structure is located in the upper part of the housing and locally illuminates the roulette wheel, wherein the structure further comprises:

an optical ring;

a support;

a spacer ring;

a band provided with lamps; and a cover, wherein the support and spacer ring form a vertical circular slit extending around an upper part of the housing, the band provided with lamps is mounted inside the vertical circular slit, the optical ring is provided along an inner periphery of the spacer ring, and the cover is placed over the optical ring and the band provided with the lamps.

2. The apparatus of claim 1, wherein the band is a flexible printed circuit board with at least two electrically conductive paths connected to the lamps.

3. The apparatus of claim 2, wherein the optical ring is a transparent material with a circular cross-section configured to diffuse the light emitted by the lamps.

4. The apparatus of claim 3, wherein the lamps are at least one of light emitting diodes and miniature light bulbs.

5. A method for assembling a structure that illuminates a roulette wheel, comprising:

forming a vertical circular slit around an upper periphery of a housing for the roulette wheel with a spacer and a support;

inserting a band provided with lamps in the vertical circular slit;

connecting the lamps of the band to at least one electrical source;

adding an optical ring along an inner periphery of the lamps; and covering the optical ring with a cover that is fastened to the housing.

* * * * *